United States Patent [19]

Mangold et al.

[11] Patent Number: 4,972,487

[45] Date of Patent: Nov. 20, 1990

[54] AUDITORY PROSTHESIS WITH DATALOGGING CAPABILITY

[75] Inventors: Stephan E. Mangold, Alingsas; Rolf C. Rising, Kungbacka, both of Sweden

[73] Assignee: Diphon Development AB, Molandal, Sweden

[21] Appl. No.: 353,220

[22] Filed: May 16, 1989

Related U.S. Application Data

[63] Continuation of Ser. No. 175,233, Mar. 30, 1988, abandoned.

[51] Int. Cl.[5] ..... H04R 25/00

[52] U.S. Cl. ..... 381/68; 381/68.2; 381/68.4; 381/60

[58] Field of Search ..... 381/68, 68.2, 68.3, 381/68.4, 60; 73/585; 128/420.6

[56] References Cited

U.S. PATENT DOCUMENTS

| | | | |
|---|---|---|---|
| 4,099,035 | 7/1978 | Yanick | 381/68.2 |
| 4,187,413 | 2/1980 | Moser | 381/68 |
| 4,357,497 | 11/1982 | Hochmair et al. | 381/46 |
| 4,419,995 | 12/1983 | Hochmair et al. | 120/420.6 |
| 4,425,481 | 1/1984 | Mansgold et al. | 381/68.2 |
| 4,471,171 | 9/1984 | Köpke | 381/68.2 |
| 4,731,850 | 3/1988 | Levitt et al. | 381/68.2 |
| 4,768,165 | 8/1988 | Hohn | 381/68.2 |

FOREIGN PATENT DOCUMENTS

| | | | |
|---|---|---|---|
| 241101 | 10/1987 | European Pat. Off. | 381/68 |
| 3642828 | 8/1987 | Fed. Rep. of Germany | 381/68 |
| 61-234700 | 10/1986 | Japan | 381/68 |
| 2184629 | 6/1987 | United Kingdom | 381/68 |

OTHER PUBLICATIONS

Cummins et al., "Ambulatory Testing of Digital Hearing Aid Algorithms", Resna 10th Annual Conference, San Jose, Calif., 1987, pp. 398–400.

M-D-D-I Reports, Jun. 8, 1987, p. 12.

Karlsson et al., "Remote Controld Programmable Hearing Aid", (Abstract) Diploma Thesis Project, Chalmers University of Technology, 1987.

World Office 83/03701, Oct. 1983, "Speech Simulation System and Method", DuBrucq.

*Primary Examiner*—Jin F. Ng

*Assistant Examiner*—M. Nelson McGeary, III

*Attorney, Agent, or Firm*—Fliesler, Dubb, Meyer & Lovejoy

[57] ABSTRACT

An auditory prosthesis is provided with datalogging capability whereby the use of a plurality of settings as selected by the user is maintained. The recorded datalog can be periodically read and used for revising a prosthetic prescription by altering the settings and used as a means of refining initial prescriptions of other patients whose audiometric characteristics are similar to those of the user. In one embodiment for a programmable auditory prosthesis the datalogging information includes the number of times control programs are changed, the number of times a given control program is selected, and the total time duration for which a given program is selected. Accordingly, the processing of signals by a signal processor can be tuned to fit the needs of an individual user. The prosthesis can have a remote control unit, and a datalog memory can be provided in the remote control unit along with a programmable memory which stores the control programs.

20 Claims, 12 Drawing Sheets

AUDITORY PROSTHESIS WITH DATALOGGING CAPABILITY

This is a continuation of application Ser. No. 175,233 filed Mar. 30, 1988, now abandoned.

BACKGROUND OF THE INVENTION

This invention relates generally to auditory prostheses and more particularly the invention relates to auditory prostheses having datalogging capabilities.

Auditory prostheses of various types are known and commercially available. Such prostheses include hearing aids, cochlear implants, implantable hearing aids, and vibrotactile devices. One such prosthesis is a programmable hearing aid; see for example U.S. Pat. No. 4,425,481. Such devices have programmable memories for controlling a signal processor for different processing of audio signals. In the specific patent referred to, the user can select one of several programs stored in memory for processing the signals by a manually-operated program control.

The conventional programmable hearing aid has a wide variety of signal-processing capabilities involving signal amplification, automatic gain control, filtering, noise suppression and other characteristics. Thus, a major problem lies in selecting the specific values or set of values of parameters to control the hearing aid for optimum use by each user. While one user might require a wide range of signal processing, another user will better utilize different programs in a more limited range of signal processing. Other conventional hearing aids, while not programmable, are user-adjustable and have similar range adjustment limitations.

SUMMARY OF THE INVENTION

Briefly, in accordance with a preferred embodiment of the invention, a datalogging capability is provided in a memory located in or associated with a programmable or manually adjustable auditory prosthesis. The memory permits recording or logging a history of certain user-selected events, such as changes in settings, parameters, or algorithms, number of times a given setting is selected, and duration for which a given setting is selected. In addition, the memory may permit recording of environmentally selected events, such as selection of settings, parameters, or algorithms, where such selection is based on an automatic computation in response to the current sound environment of the wearer. In a preferred embodiment, the method of determining the values for each of the data logs entails counting time in large segments, of the order of two minutes (128 seconds). Duration of use of each setting is then stored in units of two minutes. In a preferred embodiment, individual program settings are not recorded until after a given time period for each setting, thereby obviating the recording of many settings when the user is exploring settings for a desired response.

The control unit can be integral with the processing unit of the hearing aid or external to and coupled with the processing unit. However, in a preferred embodiment of a programmable hearing aid the control unit is remote from the hearing aid processing unit and has a transmitter (e.g. acoustical, electro-magnetic or infrared) for transmitting control signals to the processing unit. The datalog memory can be in the ear portion of the hearing aid or in the control unit. By using a remote control unit with the datalog memory therein, the ear portion can be smaller, lighter in weight, and less visible.

When the user returns the hearing aid to the dispenser, it may be reprogrammed or readjusted as appropriate in view of the data log information. The dispenser will utilize an appropriate connection to the hearing aid to read out the data stored in the data log memory. Based on this information, a new set of operating parameters can be programmed for the user. The selection of new programs is based upon interpreting the degree of use of the original programs by the user.

For example, consider a strategy of initial programming in which the memories fall on a continuum including progressive amounts of volume, noise suppression, and intelligibility enhancement. If all programs are used equally, then the programming can be considered suitable. However, if all programs are used but the signal-processing strategies at the ends of the programmed range are utilized more than those in the middle ranges, the range of parameters covered should be expanded. On the other hand, if the programs in the middle range of signal processing are primarily used, the range of programs should be contracted to provide a finer degree of selection among those settings which the user finds most helpful. It will be appreciated that other reprogramming strategies are possible, especially with other initial programming strategies.

By the word "programs" throughout this document is intended one or more of: specific settings of a limited number of parameters; selection of a processing configuration of strategy; modification of a prosthesis control program; or setting of coefficients in a prosthesis program.

The invention and other objects and features thereof will be more readily apparent from the following detailed description and appended claims when taken with the drawing.

DETAILED DESCRIPTION OF ILLUSTRATIVE EMBODIMENT

Figure 1:
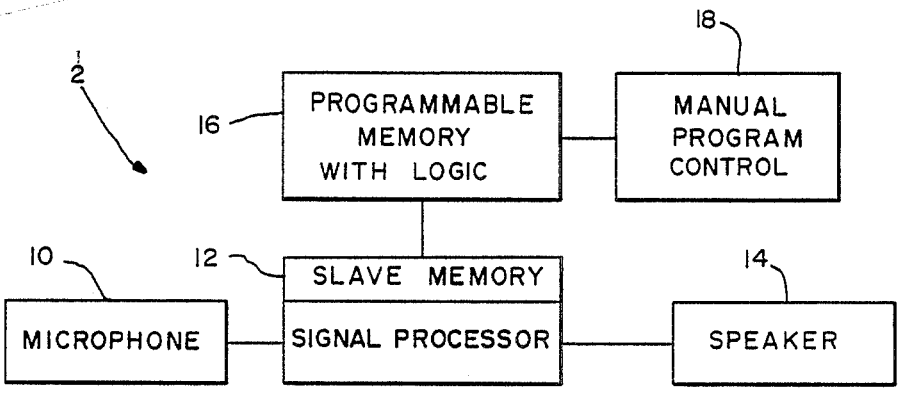
(PRIOR ART) FIG.—1
FIG. 1 is a functional block diagram of a programmable auditory prosthesis in accordance with the prior art.

FIG. 1 is a functional block diagram of a multiple-memory programmable hearing aid, shown generally at 2, such as described in U.S. Pat. No. 4,425,481 which is hereby incorporated by reference. The hearing aid 2 includes a microphone 10 for picking up sound and converting it to an electrical signal, a signal processor and associated slave memory 12 for operating on the electrical signal generated by microphone 10 in accordance with one of a plurality of signal-processing programs, and a speaker 14 for audibly transmitting the processed signals. Other signal inputs can be provided such as a tele-coil. A programmable memory with logic 16 stores a plurality of programs for controlling the signal processor 12 in operating on signals from microphone 10. A manual program control switch 18 is provided for the user of the device to select from among the several programming options stored in memory 16.

As noted above, the conventional programmable hearing aid has a wide variety of signal-processing capabilities including signal amplification, automatic gain control, filtering, and noise suppression. Thus, a major problem lies in optimizing the programming of the hearing aid for use by each individual user.

Figure 2:
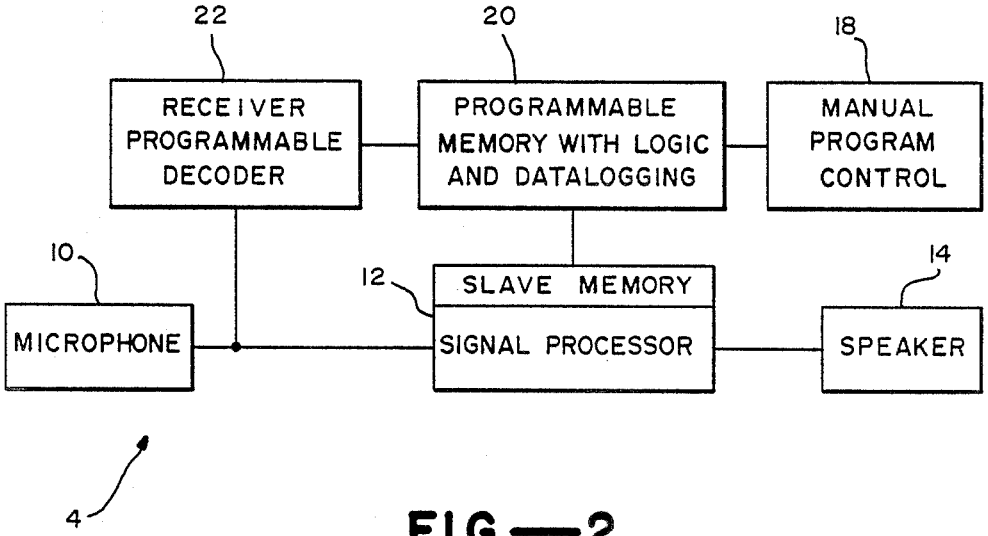
FIG. 2 is a functional block diagram of a remote-controlled programmable auditory prosthesis including datalogging function in accordance with one embodiment of the invention.

FIG. 2 is a functional block diagram of a programmable hearing aid shown generally at 4 and including datalogging capability in accordance with one embodiment of the invention. Again, the hearing aid includes a microphone 10, a signal processor with slave memory 12, and a speaker 14. However, in accordance with the invention, the programmable memory with logic further includes datalogging capability as shown at 20. A programmable decoder 22 is connected to the programmable memory 20. The decoder responds to a coded digital control signal received by the microphone 10 and transmitted from a speaker in the remote control unit to be described in FIG. 3. The carrier frequency of this control signal is in the upper part of the microphone bandwidth and will not be heard by the hearing-aid user.

Figure 3:
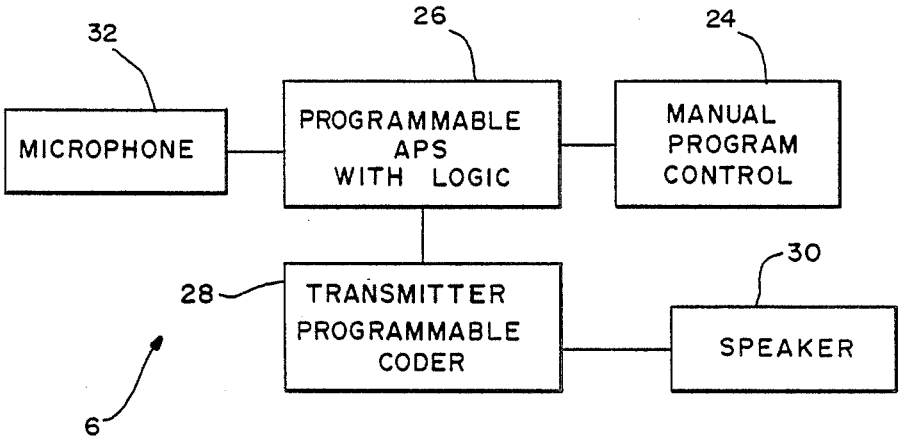
FIG. 3 is a functional block diagram of a remote control unit for use with the auditory prosthesis of FIG. 2.

FIG. 3 is a functional block diagram of the remote control unit 6 which can be placed in the user's pocket or on his wrist, for example. The remote control unit 6 is equipped with a manual program control 24 and a logic block 26 to interface with a transmitter and coder 28. The encoder as well as the decoder in the auditory prosthesis are programmed for the same ID number contained in the control signal so as not to affect other similar auditory prosthesis. The transmitter is connected to speaker 30 for transmitting the coded instructions to the hearing aid, cochlear implant, or implanted hearing aid of FIGS. 2, 3 or 4. An automatic program selector (APS) can be provided to automatically select a program in response to the ambient noise level as detected by microphone 32. In one embodiment the APS will step through the programs in the programmable block 26, and it will stop in a program where the environmental sound level has been amplified above a certain predetermined (and manually adjustable) level. This program number is then transmitted to the head-worn programmable prosthesis where the same program is entered.

In another embodiment, the level and spectrum of the sound measured at the microphone 32 is used in a calculation to determine specific values of each of the parameters constituting a program, and these parameters are then loaded via coder 28 and speaker 30 to the prosthesis across the transmitting medium (acoustic, infra-red, electromagnetic, etc.).

In accordance with a preferred embodiment of the invention, the datalogging means records or logs a the history of the number of times that settings change, the number of times a given setting is selected, and the duration for which a given setting is selected. A practical method for determining the values for each of the quantities is to count time in large segments, on the order of two minutes (128 seconds). Thus the duration is stored in units of two minutes. Additionally, settings are not recorded until after a given time segment for any given segment, thus obviating recording of settings when the settings are merely being explored by the user.

Figure 4:
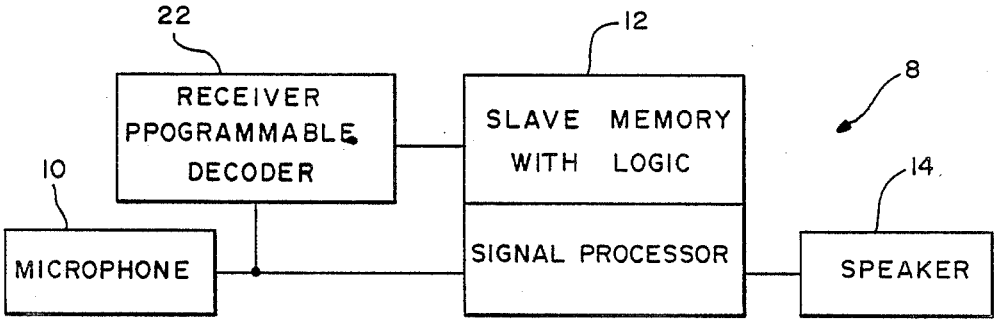
FIG. 4 is a functional block diagram of a remote-controlled programmable auditory prosthesis in accordance with another embodiment of the invention.
Figure 5:
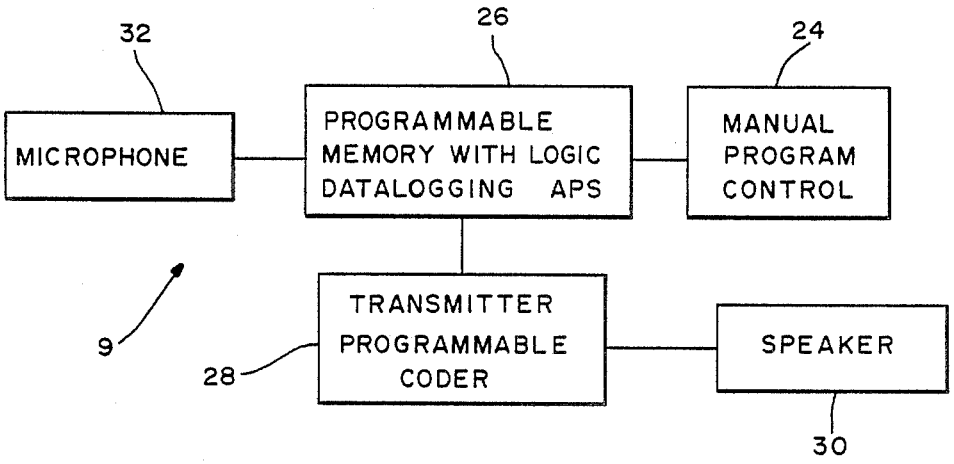
FIG. 5 is a functional block diagram of a remote control unit including the datalogging function for use the auditory, prosthesis of FIG. 4.

FIG. 4 and FIG. 5 are functional block diagrams of a hearing aid 8 and remote control unit 9, respectively, in accordance with an alternative embodiment of the invention. This embodiment is similar to the embodiment of FIG. 2 and FIG. 3, and like elements have the same reference numerals. The major difference in the two embodiments is the removal of the programmable memory with logic and datalogging unit 20 from the hearing aid of FIG. 2, and placing the functions of unit 20 in the programmable APS with logic unit 26 in the remote control unit 9 of FIG. 5. Relieving the hearing aid unit of the datalogging function reduces the size and weight of the hearing aid. Further, a more advanced programmable memory and datalogging can be implemented in the remote control unit with its larger size and greater battery power.

Figure 6:
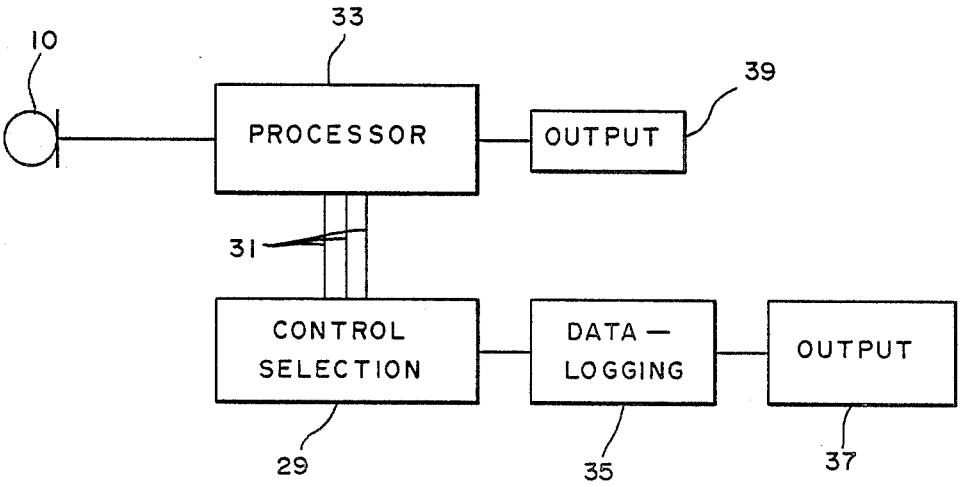
FIG. 6 is a functional block diagram of a manually adjustable, non-programmed auditory prosthesis in accordance with another embodiment of the invention.

While the invention has been described with reference to remote-controlled, programmable hearing aids in the embodiments of FIGS. 2-5, the invention can be implemented in a manually adjustable, non-programmed hearing aid or in a cochlear implant as illustrated generally in FIG. 6. In this embodiment, the manually-operated control selection 29 is connected by wires 31 to the signal processor 33. The datalogging unit 35 monitors the control selection and includes memory means for recording the extent of use of the plurality of selections. Unit 35 is periodically read from the output 37. The output 39 can be an acoustic speaker or a cochlear implant such as disclosed in U.S. Pat. No. 4,357,497 or U.S. Pat. No. 4,419,995, incorporated herein by reference. Finally, the invention can also be used in a prosthesis in which the mode or manner of operation is switched automatically. In this case, the datalogging information is employed to monitor the suitability of the decision algorithm used to effect the automatic switching or adjustment.

It should be understood that "programs" within this discussion refers to one or more of: specific settings of a limited number of parameters; selection of a prosthetic configuration or processing strategy in a prosthesis which is designed so that multiple modes of processing may be selected; selection of a particular algorithm or form of an algorithm microprocessor or set of microprocessor instructions; or modification of the constants or coefficients of a microprocessor-controlled set of instructions, such as changes in the number and value of filter coefficients in a digitally controlled or implemented filter (e.g. FIR or IIR filter).

Figure 7A:
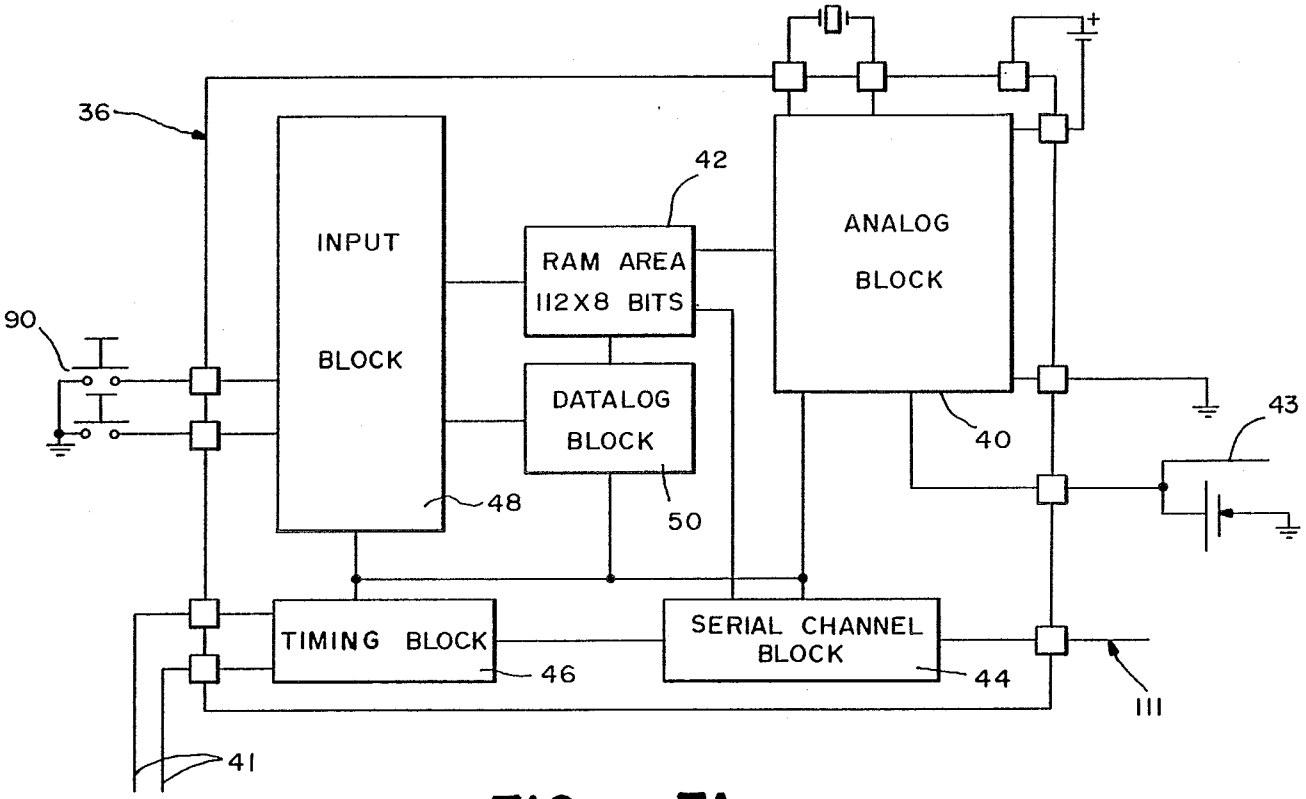
FIGS. 7A, 7B and FIG. 7C are a more detailed functional block diagram of the programmable auditory prosthesis of FIG. 2.
Figure 7B:
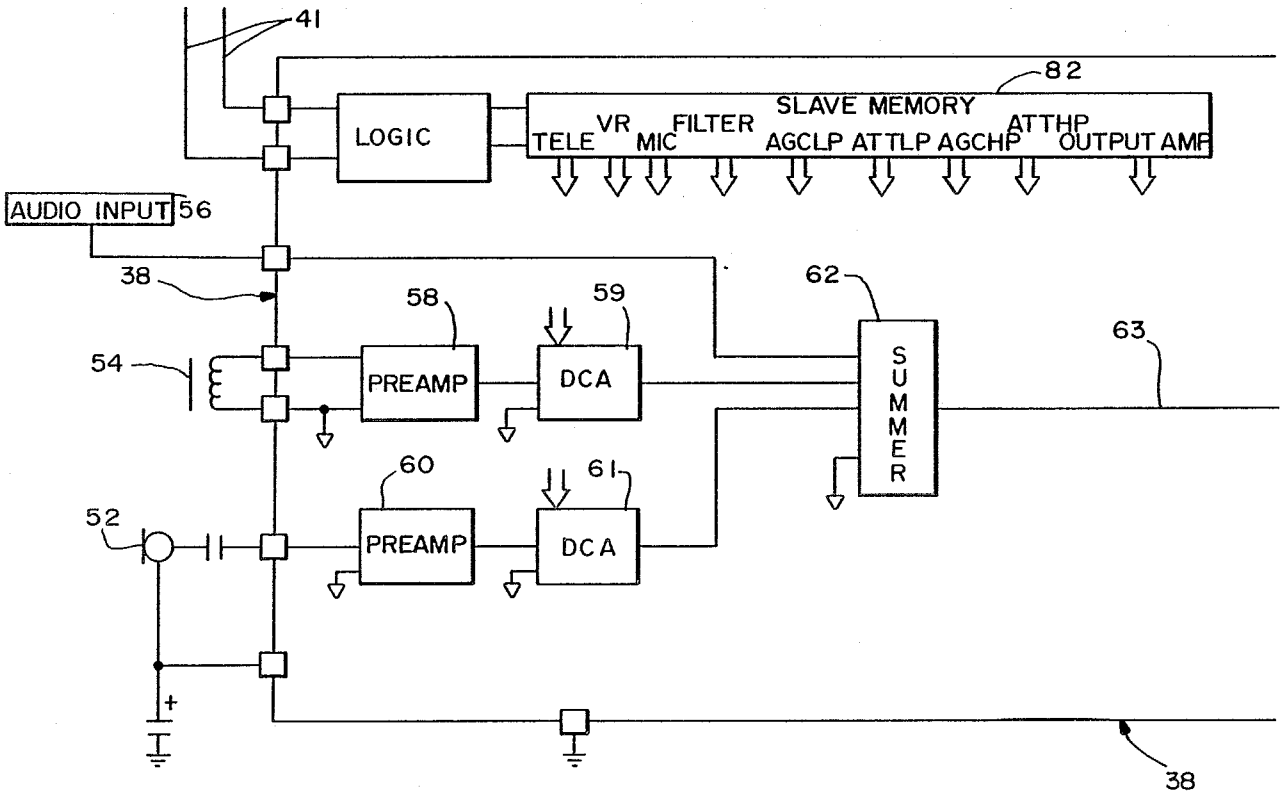
Figure 7C:
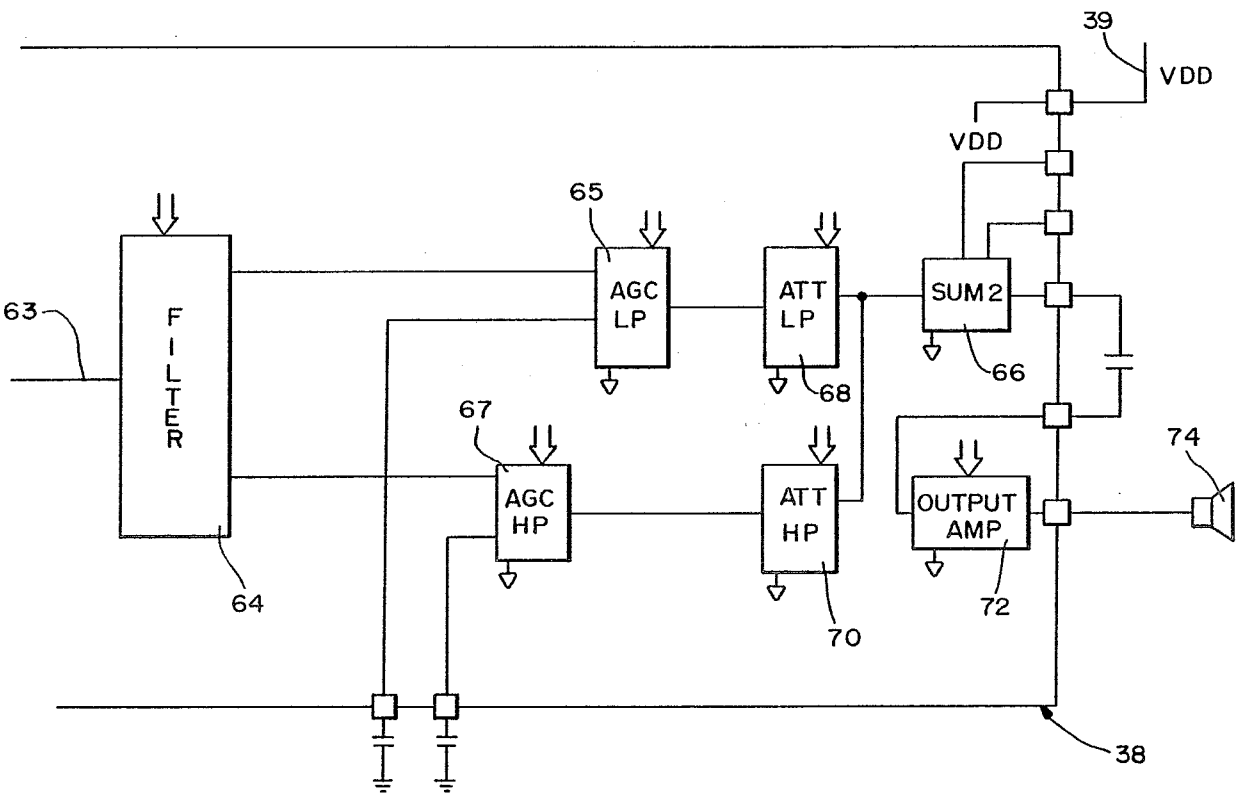

FIGS. 7A, 7B and 7C are a more detailed functional block diagram of the programmable hearing aid 4 with datalogging, as shown in FIG. 2. This embodiment has been built in two integrated circuits illustrated generally at 36 and 38 with circuit terminals denoted by square symbols. Integrated circuit 36 (FIG. 7A) comprises a memory 42 which transfers portions of its stored information to the slave memory 82 in the analog signal processor in FIG. 7B via lines 41. Integrated circuit 36 includes an analog block 40 containing a voltage doubler (charge pump) and an oscillator controlled by an external crystal at 32,768 Hz. When the device is turned on, the minus pole of the supply battery is connected to ground and the oscillator starts with the help of a back-up battery. The oscillator starts the voltage doubler which generates negative voltage VSS with the voltage doubler and a buffer capacitor. When the device is turned off, a voltage level detector is activated and the back-up is connected again to secure the data in the RAM.

RAM 42 consists of a total of 896 bits organized in 112×8 bits. The 112 groups of bits for each listening situation are divided into 64 bits for slave memory, 4 bits of tele-coil control, and 24 bits for datalogging.

A serial channel block 44 is utilized to program and/or read the RAM area by an external programming unit. The data can be written to or read from the hearing aid via serial line connection 111. Timing block 46 keeps track of timing for the different blocks and transfers data and generates clock pulses to the slave memory. The input and test block 48 controls the activities of the external switches and the power reset pulse from the analog block.

The datalogging block 50 provides logic for RAM 42 which includes two datalog registers of 12 bits each for each program setting. The first register is incremented whenever a listening situation has been used for more than two minutes. The second register is incremented each fourth minute as long as the listening situation is used. A separate register of 24 bits is incremented whenever a switch 90 has been actuated.

The signal processor 38 in FIG. 7B includes a microphone input 52, a tele-coil input 54 and an audio input 56. The tele-coil and microphone inputs are passed through preamplifiers 58 and 60 and digitally controlled attenuators 59 and 61, respectively, and, together with the audio input signal, are summed in SUM unit 62. The output from unit 62 is passed via line 63 to a filter 64 (FIG. 7C) which splits the signal into a low-pass signal and a high-pass signal. The crossover frequency between the low- and high-pass channels can be varied digitally from 500 Hz to 4 KHz.

The circuits for the low-pass filter 65 and high-pass filter 67 are identical and consist of automatic-gain-controlled amplifiers. The release time of the AGC can be controlled to effect soft clipping (i.e., zero release time), short, normal and long release times.

The low- and high-pass channel signals are summed together at 66 via digital attenuators 68 and 70.

An output amplifier 72 is provided for receiving the summed output at 66 and driving a transducer 74. Alternatively, an external output amplifier can be used to perform the driving function.

The digital portion of the chip 38 includes logic 80 and slave memory 82 (FIG. 7B). The slave memory 82 is a 55-bit non-resettable shift register, where data is shifted into the register in series by each positive clock-transition. The information in the slave memory controls the various functions in the analog circuits. A 64-bit data word is loaded into the slave memory together with 64 clock pulses.

As above described, the datalogging logic performs three specific logic functions. First, the total number of times new data is sent to the device is logged. A total of 24 bits is available in this register (16,777,215 events). This logging function is referred to herein as Data-Log Sum (DLS). The second function of the datalogging is to record the number of times a particular register is used for more than 128 seconds (2.13 minutes). There are 12 bits in each of the 8 registers used for this type of logging (4095 events). This logging function is referred to herein as Data Log A (DLA). The third function records the amount of time each particular register has been active. Each time count equals 256 seconds (4.27 minutes). Again, there are 12 bits in each of the 8 registers (approximately 291 hours). This logging function is referred to herein as Data Log B (DLB). The actual incrementing of registers is carried out in the data buffer portion of the RAM block.

Figure 8:
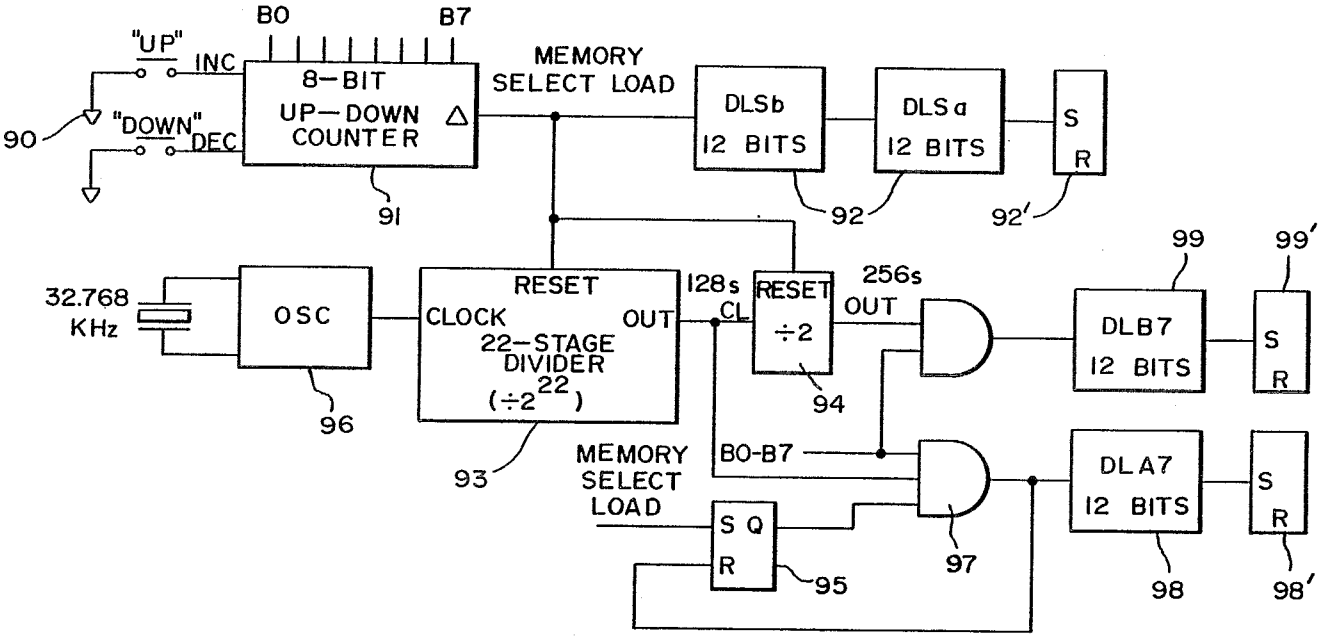
FIGS. 8—13 are functional block diagrams illustrating the functioning of the datalogging in the auditory prosthesis.

FIGS. 8–13 are more specific details for the circuitry in FIG. 7B for implementing the datalogging function. While this implementation is hard-wired, it will be appreciated that the functions of the circuitry can be implemented with a programmed microprocessor, for example. In FIG. 8, the datalogging record-keeping includes UP and DOWN buttons shown at 90 which cause the 8-bit counter 91 to count up and down, so that at any time, one and only one of the 8 outputs B0–B7 is active (high). When this output has changed to a new value and is stable, the DELTA (Δ) output generates a pulse, called Memory Select Load.

Whenever Memory Select Load (MSL) is pulsed, this increments the DLS counter 92, which totals the number of switching events. At this time also, the 22-stage divider 93 and the divide-by-2 flip-flop 94 are reset, so that their state is zero. The MSL pulse also sets the RS flip-flop 95 which enables loading of the DLA registers 98.

Once the dividers 93 and 94 are reset, the free-running 32768 Hz crystal oscillator 96 causes the divider 93 to begin counting up. When divider 93 has counted $2^{22}$ counts, its output goes high, being 128 seconds after the MSL pulse occurred.

The output of the 22-stage divider 93 gives a pulse which is ANDed at gate 97 with one of the selectively connected bits B0–B7 of up-down counter 91 and the Q output of RS flip-flop 95 set by MSL. This produces an increment to the DLA register 98. The change in the input to the DLA register is used to reset the RS flip-flop 95, so that only one increment to the DLA register is accomplished per change of the 8-bit up/down counter, and due to the divider 93 this increment occurs only if the state of the counter has remained constant for over two minutes.

When the output of the 22-stage divider 93 is divided by 2, in divide by 2 FF 94, the result is used to increment the relevant DLB register 99, every 256 seconds during which the associated bit B0–B7 of up-down counter has been selected.

In addition, all registers may be provided with an RS flip-flop (identified by a prime number), which is set whenever the relevant register overflows. In this way, data read out of the hearing aid can be interpreted even with use times exceeding $256 \times 2^{12}$ sec.

Figure 9:
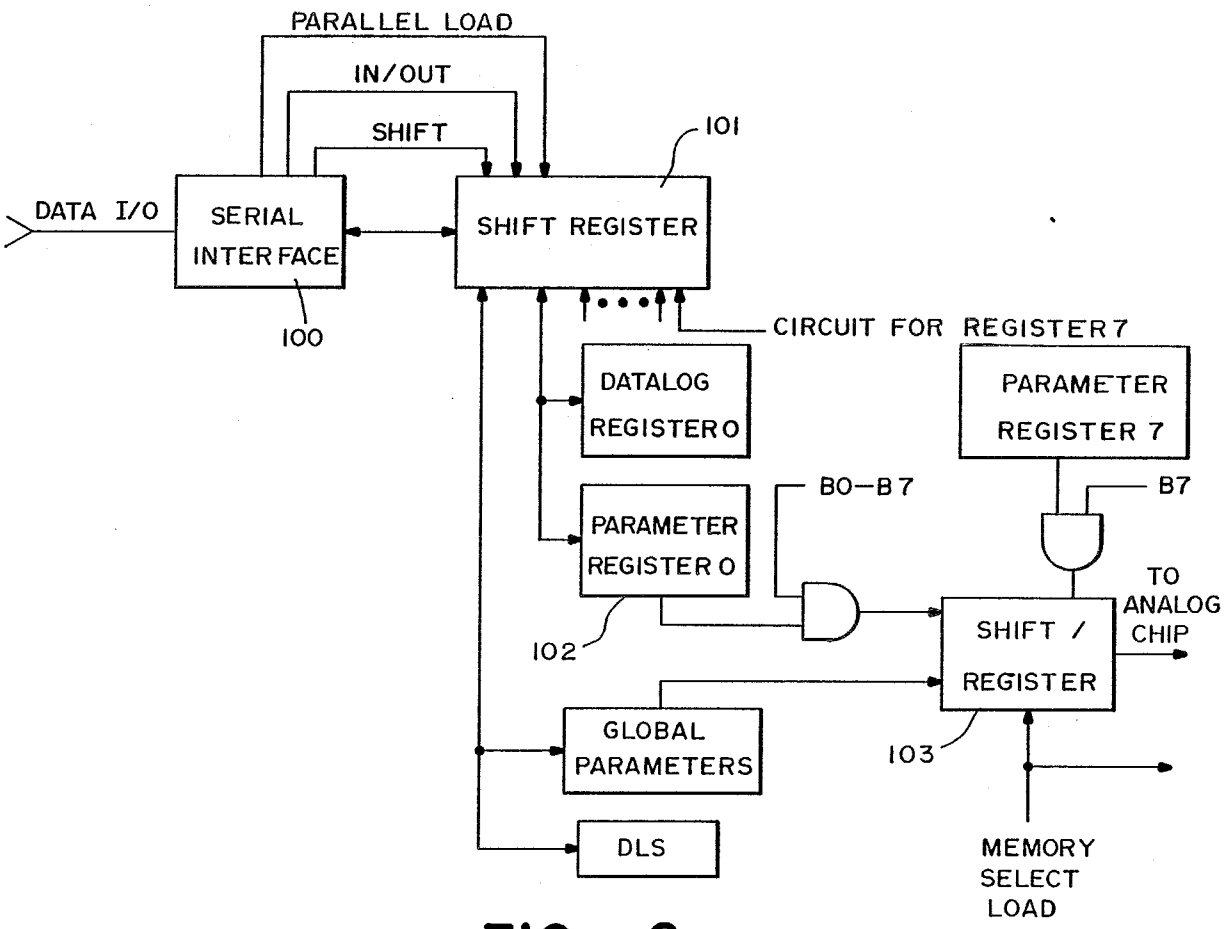

The hearing aid communicates to the outside world through a serial interface 100 shown in FIG. 9. This communication is managed by conventional logic, which detects appropriate instructions to load the hearing aid from the programmer, or to send information about the hearing aid setting or datalogging information back to the programmer. In addition, an access code is checked on the input from the programmer to ensure that changes in the hearing aid program cannot be made inadvertently.

The data in the selected register 102 passes through a shift register 101. This enables the datalogging information (DLS, DLA and DLB registers), global programming information (e.g., number of active memories), and individual parameter registers 102 (for memories 0–7) to be either read or written.

When MSL pulse is generated, the contents of the appropriate parameter register 102 (selected by B0–B7) are loaded into a second shift register 103, and then these data are clocked serially into the slave memory 82 of analog integrated circuit 38 (FIG. 7B).

It will be appreciated that appropriate circuit modifications may be made to allow the functions of the shift registers and storage registers to be performed by the same circuit, but the operation is presented in FIG. 9 to clarify details of the communication between the logic and analog hearing-aid circuitry, such as shown in U.S. Pat. No. 4,425,481, supra. Though functionally the circuit operates as discussed above, there can be one large RAM random access memory structure, and not distinct data registers, and there can be a single 16-bit shift register which serves as the heart of communication to and from the digital control circuit.

Figure 10:
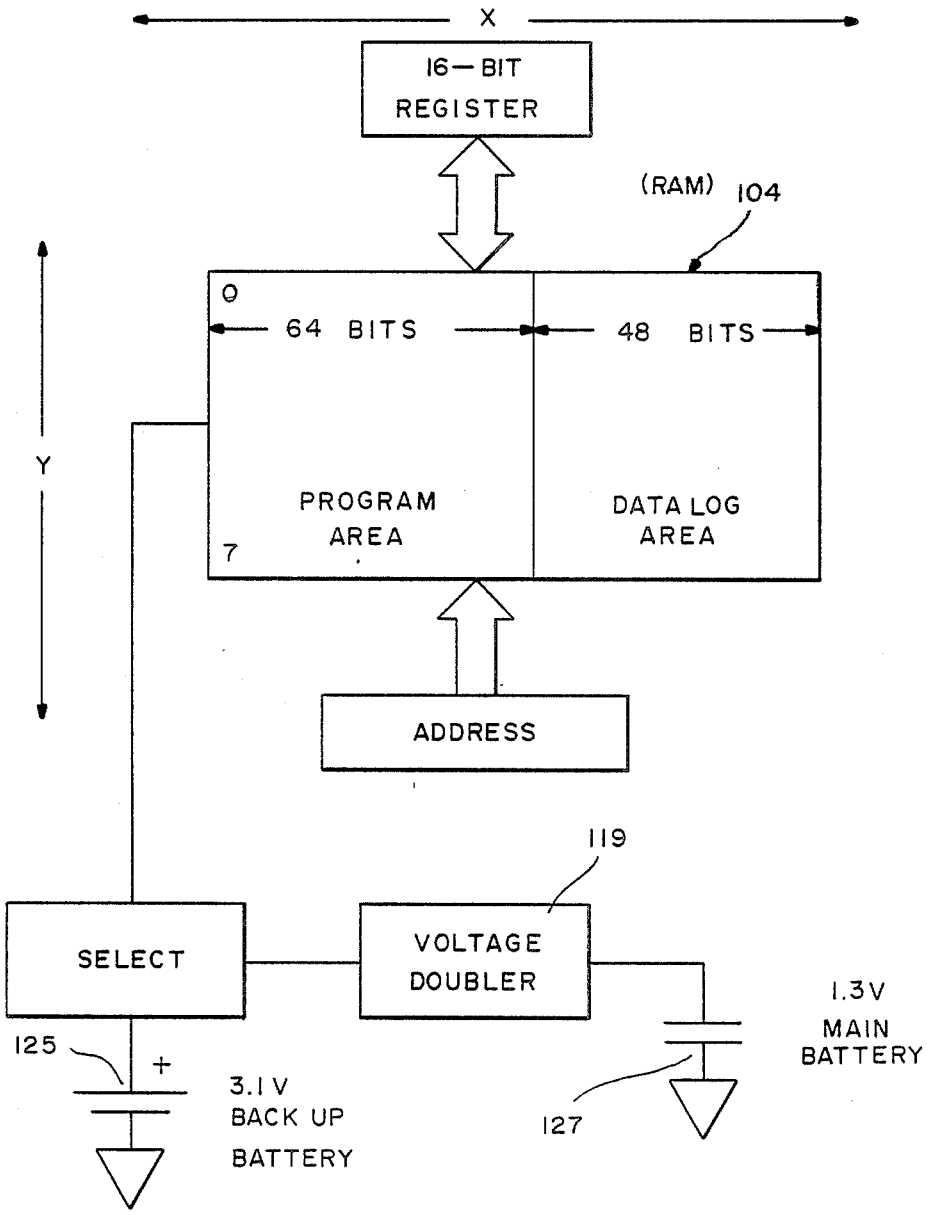

The internal RAM on the digital circuit 36 is arranged into an XY matrix as shown in FIG. 10. Selecting a memory sets the Y value 0 through 7 in the RAM; specific functions, such as loading the memory into the analog circuit 38 or incrementing the datalogging registers 92, 98 or 99 (FIG. 8), select the X value (that is, the particular 16-bit cell of the matrix) used in the current operation. The contents of the random access memory 104 (FIG. 11) is held by continuous application of a backup voltage 125. When the hearing aid is not in active use, this is the only voltage which is maintained. When a regular 1.3 V hearing-aid battery 127 is in the hearing aid, backup voltage is derived via a voltage doubler 119 (required because of the characteristics of the integrated circuit processes used). If the usual 1.3 V battery 127 is removed, the internal 3.1 V lithium battery 125 supplies the minimal current needed to keep the memory contents from changing.

Figure 11:
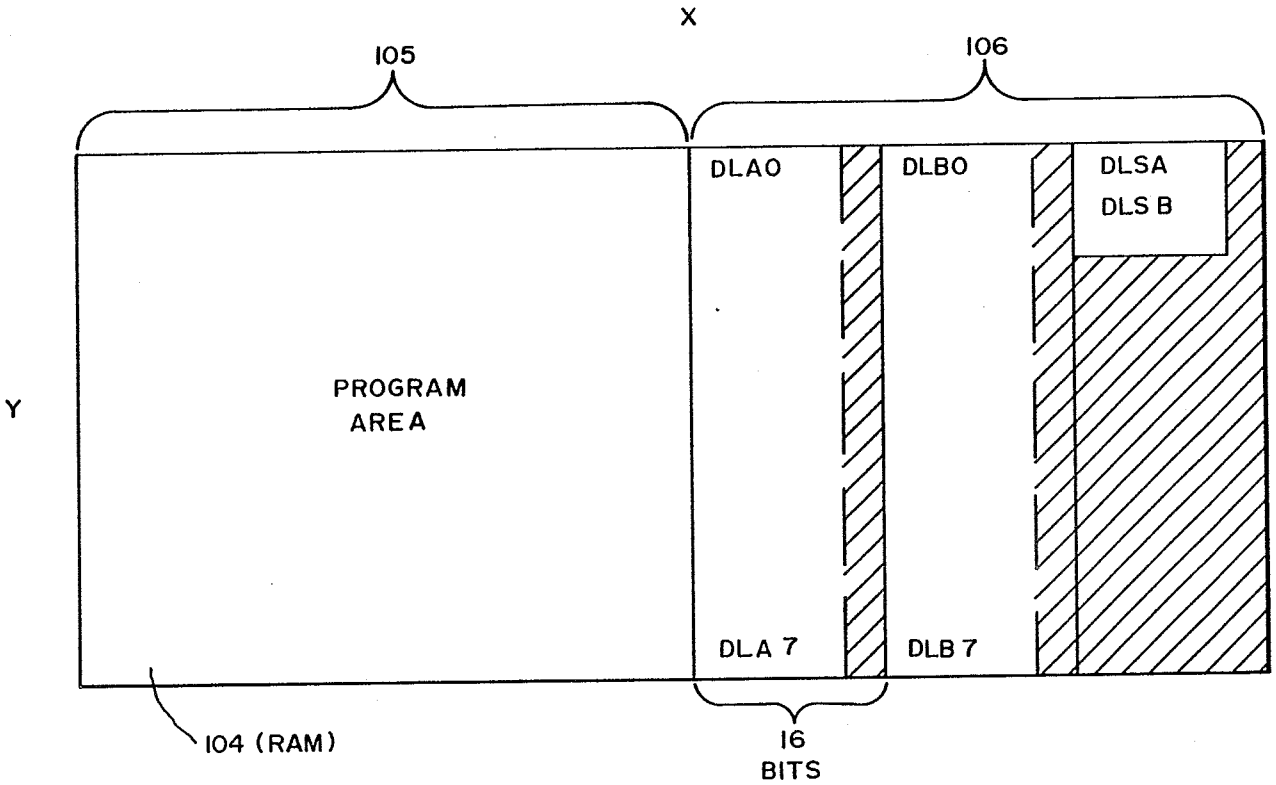

The RAM 104 is effectively partitioned for each memory into a 64-bit parameter field 105 and a 48-bit field 106 used for datalogging. The organization of the datalogging area is given more specifically in the RAM layout diagram (FIG. 11).

Figure 12:
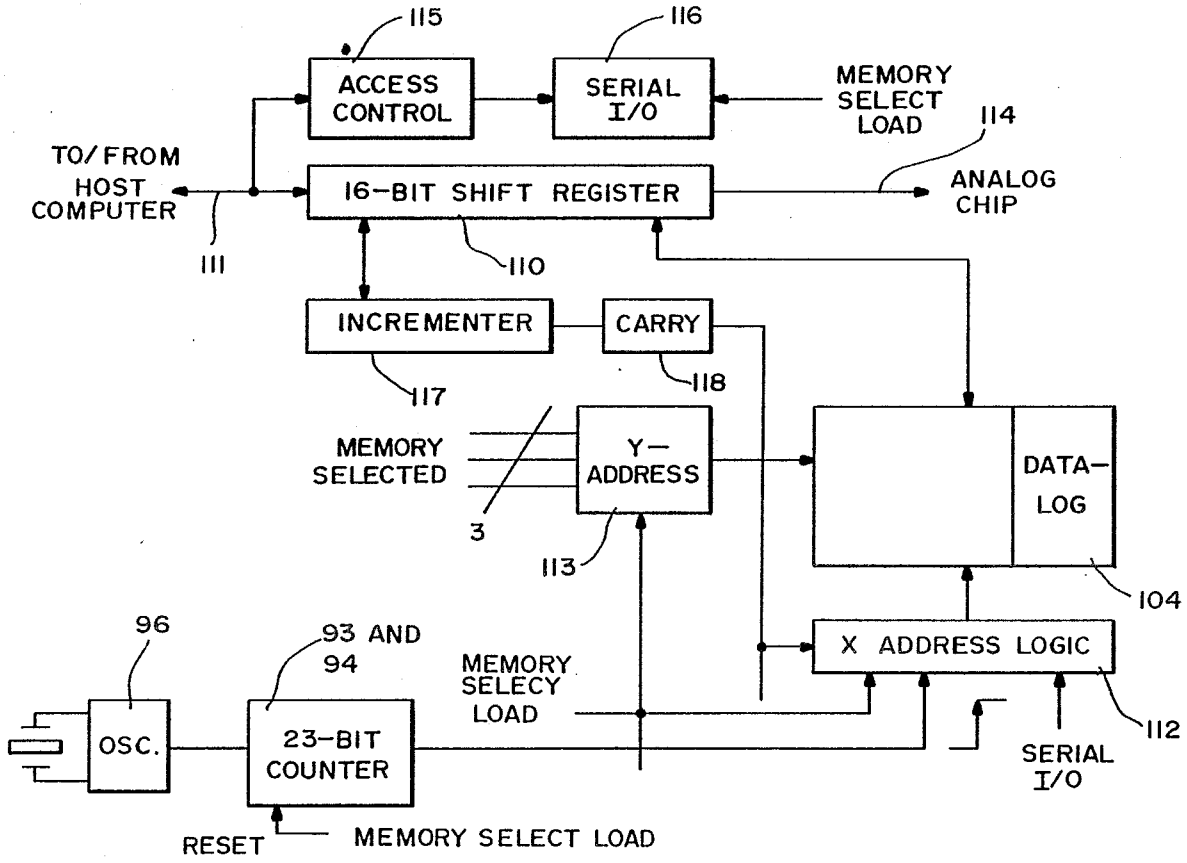

The heart of the logic functions to support the programmable hearing aid is the 16-bit register 110 shown in FIG. 12, which serves as: a serial-in, parallel-out register for the incoming data; a parallel-in, serial-out register for programming the hearing aid or reading back the RAM to the host; and a parallel-out, parallel-in incrementing register for datalogging recording. The communications functions (host programming, hearing aid programming, and data read-back) are controlled by a serial interface upon receipt of the appropriate codes.

Operation for programming the hearing aid.

After the preamble access code is checked by access control block 115 and successfully received from the host, the serial input/output control 116 resets the address counter 112, and begins clocking the data in, 16 bits at a time, over the serial line 111. When each 16 bits accumulate, they are transferred to the RAM memory 104. This process continues until the whole memory is rewritten.

Operation for reading the hearing aid.

When the readout access code is received from the host, the serial input/output control 116 resets the address counter 112 and moves 16 bits into the shift register 110, and begins clocking them out the serial line 111. This process continues until the contents of the whole memory 104 have been sent via the serial line 111.

Operation for setting the analog circuit.

When a new memory is selected, the Y register 113 is changed to reflect the different memory selected. The X register 112 is set at zero, and an operation begins in which four successive 16-bit words are loaded into the shift register 110 and shifted out to the analog circuit 38 via line 114. Thus, 64 bits of programming information are delivered to the analog chip 38.

Operation for incrementing the datalogging bits.

Figure 13:
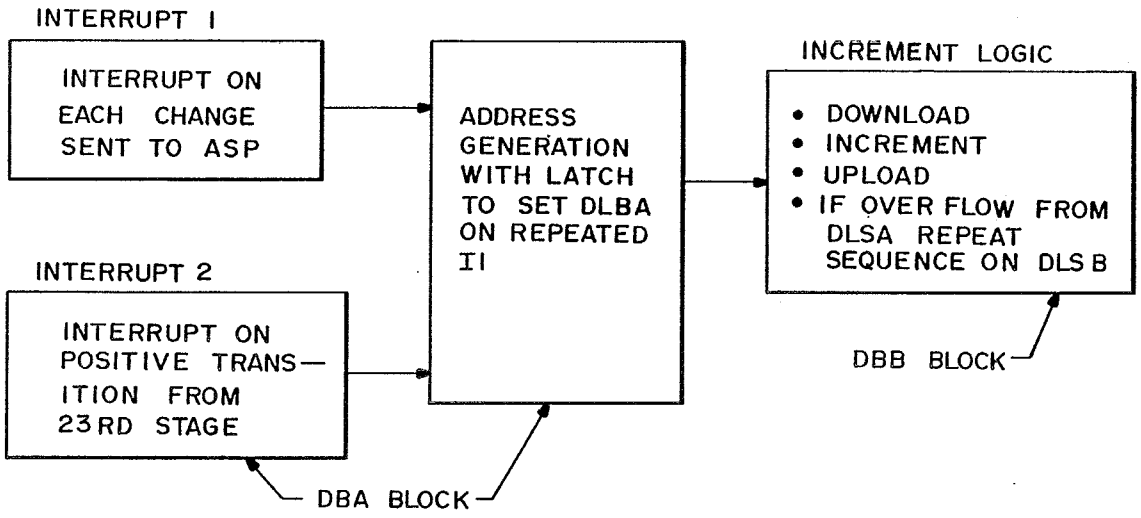

The general concept of the operation is described in the basic structure shown in FIG. 13. Whenever the active memory is changed, manually or automatically, this: (1) generates an interrupt, and resets the 23-stage counter 93 and 94; (2) changes the address in the logic 112 and 113; (3) fetches the value of DLSa; (4) increments DLSa; (5) puts DLSa back in memory 104; (6) if step 4 overflowed (resulted in a count exceeding 12 bits), repeat 3, 4 and 5 with DLSb; (7) set a latch to enable DLA and DLB to be incremented on future clock pulses. If, 128 seconds after the active memory is changed, Memory Select Load has not been pulsed again, the positive-going transition from the output of the 23-stage counter 93 and 94 causes an increment cycle on DLA: (1) fetch DLA; (2) increment; and (3) return to memory. Subsequent positive-going cycles of the counter 93 and 94 output cause similar increments in DLB.

Thus, the counting implemented is as follows: (a) DLSa (LSB) and DLSb (MSB) are incremented immediately upon each change from one memory to another; (b) DLA is incremented once after the first 128 seconds in the same memory; and (c) DLB is incremented every 256 seconds after the incrementation of DLA. Note that in this implementation means the first incrementation of DLB occurs 128+256 seconds after memories are changed. This structure is implemented by using the positive-going transition at the output of the 23-bit counter 93 and 94, with the counter arranged in such a fashion that the first positive-going transition occurs at 128 seconds after a reset, but the period of the counter is actually 256 seconds between positive-going transitions.

The increment logic is part of the 16-bit shift register 110. Incrementation is implemented by attaching 12 half-adders to the 12 least significant bits of the shift register in incrementer 117. Carry output is latched in carry register 118. The ouput of carry register 118 is used in the DLS computation to generate a second increment cycle for DLSb if required.

In the organization of the datalogging area of the RAM, the address generation for DLSa and DLSb in units 112 and 113 is facilitated by sensing exception conditions and temporarily redirecting the Y register 113 to that appropriate to memories 0 and 1, and the X register 112 to the last word in those registers.

As above described, once the user has had the hearing aid in use for a period of time, the user returns the hearing aid to the dispenser. The dispenser then uses an appropriate connection to the hearing aid to read out the data stored in the datalogging information memory. Using this information, a new set of programs can be stored in memory for the user. Selection of the new programs is based on interpreting the degree to which the original programs are used.

It should be clear that the concept of datalogging depends on the ability to provide multiple settings for the hearing prosthesis, along with being able to record the duration of those settings. This information is adaptable either to memories which reside within the prosthesis memories which are controlled from a remote-control source, or to memories within a remote-control source in which case the datalogging means is advantageously contained in the remote-control source.

The datalogging information can be used not only to revise a hearing prescription for an individual instrument; it can also be used for refining the initial prescriptions of future patients whose audiometric characteristics are similar to those of the user.

While the invention has been described with reference to specific embodiments, the description is illustrative of the invention and is not to be construed as limiting the invention. Various modifications and applications may occur to those skilled in the art without departing from the true spirit and scope of the invention as defined by the appended claims.

What is claimed is:

1. A portable auditory prosthesis for personal use, being adjustable by a user in a plurality of processing modes, comprising:

signal input means for providing an electrical signal indicative of an audio signal, signal processor means operably connected to receive said electrical signal for processing said electrical signal according to a selected one of said plurality of processing modes to create a processed electrical signal, control means actuated by the user and operably coupled with said signal processor means for controlling said signal processor means to operate in one of said plurality of processing modes, datalogging means coupled with said control means for recording a history of the selection by the user of said plurality of processing modes of operation, reading means operably coupled with said datalogging means for reading said selection recorded in said datalogging means, and transducer means connected with said signal processor means for generating an electrical signal in response to said processed electrical signal.

2. An auditory prosthesis according to claim 1 where said transducer means comprises an acoustic transducer.

3. An auditory prosthesis according to claim 1 where said transducer means comprises an electrode in the cochlea.

4. An auditory prosthesis according to claim 1 where said transducer means comprises an electrode in the vicinity of the cochlea.

5. An auditory prosthesis according to claim 1 where said transducer means comprises a mechanical transducer.

6. An auditory prosthesis as defined in claim 1 wherein said signal processor means is manually adjustable.

7. An auditory prosthesis as defined by claim 1 wherein said datalogging means comprises a memory for storing a recording of the selection of said plurality of processing modes of operation and the period of use of said processing modes of operation.

8. An auditory prothesis as defined by claim 1 wherein said history includes the number of times of use by the user of said processing modes of operation.

9. A portable programmable auditory prosthesis for personal use by a user comprising signal input means for providing an electrical signal indicative of an audio signal, signal processor means connected to receive said electrical signal and processing said electrical signal in response to a control program, programmable memory means operably coupled to said signal processor means and storing a plurality of control programs for controlling said signal processor means, control means actuated by the user and operably coupled with said programmable memory means and permitting a user to select a control program, datalogging means operably coupled with said programmable memory means and said control means for recording a history of the selection of control programs by the user, said datalogging means being readable for adjustments of said plurality of control programs based on the wearer's actual use, means coupled with said datalogging means for reading said datalogging means, and transducer means connected with said signal processor means for receiving a processed electrical signal and generating an electrical signal in response thereto.

10. The programmable auditory prosthesis as defined by claim 9 wherein said control means is remotely coupled to said signal processor means, said control means including signal transmission means for transmitting control signals to said signal processor means.

11. The programmable auditory prosthesis as defined by claim 10 wherein said control signals are transmitted as audio signals, said signal input means including a microphone for receiving said control signals.

12. The programmable auditory prosthesis as defined by claim 10 wherein said programmable memory means and said datalogging means are located in said control means.

13. The programmable auditory prosthesis as defined by claim 10 wherein said programmable memory means and said datalogging means are electrically interconnected with said signal processor means.

14. The programmable auditory prosthesis as defined by claim 10 wherein said control means includes a microphone means for receiving audio signals and automatic program selection means responsive to characteristics of audio signals received by said microphone means for automatically selecting a control program.

15. The programmable auditory prosthesis as defined by claim 14 wherein said datalogging means records the total number of times the control program for said signal processor means is changed, the number of times each control program is used for at least a minimum period of time, and the total time each control program is utilized.

16. The programmable auditory prosthesis as defined by claim 15 wherein each control program controls amplification, noise suppression, and intelligibility enhancement of an electrical signal by said signal processor means.

17. The programmable auditory prosthesis as defined by claim 9 wherein said datalogging means records the total number of times the control program for said signal processor means is changed, the number of times each control program is used for a minimal period of time, and the total time each control program is utilized.

18. The programmable auditory prosthesis as defined by claim 17 wherein each control program controls amplification, noise suppression, and intelligibility enhancement of an electrical signal by said signal processor means.

19. The portable programmable auditory prosthesis as defined by claim 9 wherein said history includes the number of times of use by the user of said control programs.

20. A method of programming a programmable auditory prosthesis to fit an individual user comprising the steps of (a) adjusting the prosthesis for a plurality of signal processor control programs, (b) recording in a datalog memory a histogram on the use of said plurality of signal processor control programs, (c) periodically reading said histogram, and (d) revising said plurality of signal processor control programs stored in said auditory prosthesis based on said histogram.

* * * * *

UNITED STATES PATENT AND TRADEMARK OFFICE

CERTIFICATE OF CORRECTION

PATENT NO. : 4,972,487

DATED : November 20, 1990

INVENTOR(S) : Stephan E. Mangold and Rolf C. Rising

It is certified that error appears in the above-identified patent and that said Letters Patent is hereby corrected as shown below:

Col. 2, line 53-54, "for use the auditory, prosthesis" should read --for use with the auditory prosthesis--.

Col. 3, line 68, "or logs a the" should read --or logs a--.

Col. 9, line 61, "in claim 1" should read --by claim 1--.

Signed and Sealed this

Twenty-third Day of November, 1993

*Attest:*

*Attesting Officer*

Bruce Lehman

BRUCE LEHMAN

*Commissioner of Patents and Trademarks*